US006578568B1

(12) United States Patent
Dufort et al.

(10) Patent No.: US 6,578,568 B1
(45) Date of Patent: Jun. 17, 2003

(54) FIRE PIT GRILL WITH A VERTICALLY FOLDABLE BRACKET ON A ROTATABLE SLEEVE

(76) Inventors: Richard Dufort, 32675 Coach, New Baltimore, MI (US) 48047; Louis Ristovski, 51046 Dequindre, Utica, MI (US) 48317

( * ) Notice: Subject to any disclaimer, the term of this patent is extended or adjusted under 35 U.S.C. 154(b) by 0 days.

(21) Appl. No.: 09/909,424

(22) Filed: Jul. 19, 2001

Related U.S. Application Data

(60) Provisional application No. 60/219,401, filed on Jul. 19, 2000.

(51) Int. Cl.[7] ..... F24B 3/00

(52) U.S. Cl. ..... 126/30; 126/25 A; 126/9 B; 126/9 R; 99/339; 99/393; 99/399; 248/156

(58) Field of Search ..... 126/30, 29, 25 R, 126/9 R, 9 B, 25 A, 40, 25 AA; 99/421, 339, 449, 448, 450, 389–397, 399; 248/156, 218.4, 122.1, 123.11, 278.1

(56) References Cited

U.S. PATENT DOCUMENTS 2,550,338 A * 4/1951 Dunagan ..... 126/30
2,604,884 A * 7/1952 Walker ..... 126/30
2,698,726 A * 1/1955 Howe ..... 248/528
2,844,139 A * 7/1958 Lucas ..... 126/25 A
2,960,979 A * 11/1960 Stone ..... 126/25 A
2,974,662 A * 3/1961 Forrest ..... 126/30
3,045,660 A * 7/1962 Manley et al. ..... 126/30
3,152,536 A * 10/1964 Lucas ..... 126/30
3,162,113 A * 12/1964 Tallaksen ..... 99/446
3,395,692 A * 8/1968 Johns ..... 126/30
4,065,085 A * 12/1977 Gellatly ..... 126/30
4,094,296 A * 6/1978 Beagley ..... 126/30
4,437,450 A * 3/1984 Connelly ..... 126/30
4,538,589 A * 9/1985 Preston ..... 126/25 A
4,607,608 A * 8/1986 Allred et al. ..... 126/25 A
4,719,898 A * 1/1988 Stanislawski ..... 126/9 R
4,854,297 A * 8/1989 Shuman ..... 126/30
D344,207 S * 2/1994 Bauman ..... D7/335
5,447,096 A * 9/1995 Burge et al. ..... 126/25 A
5,848,584 A * 12/1998 Brog ..... 126/30
5,944,009 A * 8/1999 Scheller ..... 126/25 R
6,105,569 A * 8/2000 Andress ..... 126/25 A

* cited by examiner

*Primary Examiner*—Henry Bennett
*Assistant Examiner*—Kathryn Ferko
(74) *Attorney, Agent, or Firm*—James M. Deimen

(57) ABSTRACT

A new fire pit grill comprises a vertical support that may be driven into the ground or otherwise supported in a vertical position. On the vertical support is an adjustable stop which may be set at any desired height. Resting on the stop is a sleeve and bracket which in turn support a grill surface. Opposite the bracket, the sleeve supports a handle whereby the bracket and grill surface can be rotated over and away from a fire below the grill.

10 Claims, 8 Drawing Sheets

16
22
42
24
46
28
44

42
44
26
18
10
~12~

10
42
44
22
26
18
~12~
10
18

FIRE PIT GRILL WITH A VERTICALLY FOLDABLE BRACKET ON A ROTATABLE SLEEVE

This application claims the benefit of provisional patent application No. 60/219,401, filed Jul. 19, 2000.

BACKGROUND OF THE INVENTION

The field of the invention pertains to grills for outdoor cooking and, in particular, to grills positioned over an open flame produced by burning wood, charcoal, propane or natural gas, for example.

In common use are a large variety of fixed or portable "bar-be-que grills" wherein the grill and fire containing (and producing) apparatus are part of the fixed or portable unit. Typically, the fixed units are either constructed of cast metal and fired by natural gas or masonry and fired by wood or charcoal. The portable units are typically metal with wheels and handles and fired by propane or charcoal. Whether fixed or portable, the food supporting metal grill is removable for cleaning.

Campers have traditionally built cooking fires on the ground or in fire pits dug into the ground. In more recent years, fire pits have become popular in some rural and resort areas. With a view toward making cooking more pleasurable over an open fire on the ground or dug into the ground, the new fire pit grill described below has been created.

U.S. Pat. No. 1,666,293 discloses a camp fire outfit with a grill and other accessories adjustable vertically and able to swivel. U.S. Pat. No. 2,977,953 also discloses a vertically adjustable grill that swivels about a post.

The picnic grill shown in U.S. Pat. No. 3,045,660 folds vertically against a vertical tripod support. U.S. Pat. No. 3,526,217 discloses a center post mounted grill and U.S. Pat. No. 4,351,312 discloses a post supported grill with limited adjustability.

U.S. Pat. Nos. 4,979,490 and 5,307,797 disclose portable camp fire grills with an arm that extends to the opposite side of the post for a handle. U.S. Pat. No. 6,006,740 discloses a grill support post that also serves as a handle to carry the grill when disassembled and U.S. Pat. No. Des. 369,939 discloses a grill welded to a sleeve that serves as both an arm and a holder for the vertical post.

SUMMARY OF THE INVENTION

The new fire pit grill comprises a vertical support that may be driven into the ground or otherwise supported in a vertical position. On the vertical support is an adjustable stop which may be set to any desired height. Resting on the stop is a sleeve freely rotatable about the vertical support. The sleeve supports a bracket which, in turn, supports a grill surface. Opposite the bracket, the sleeve supports a handle whereby the bracket and grill surface can be rotated over and away from a fire below the grill. Rotation of the grill allows food to be placed on and removed from the grill without reaching over a hot fire.

In the preferred embodiment below described, the entire fire pit grill is constructed of stainless steel with the exception of a wooden or plastic handle. By constructing the fire pit grill of stainless steel, the new grill will last indefinitely, even if left in place over the fire pit as a permanent fixture. However, the construction allows the bracket, sleeve and handle to be easily removed from the vertical support for indoor storage.

DESCRIPTION OF THE PREFERRED EMBODIMENT

Figure 1:
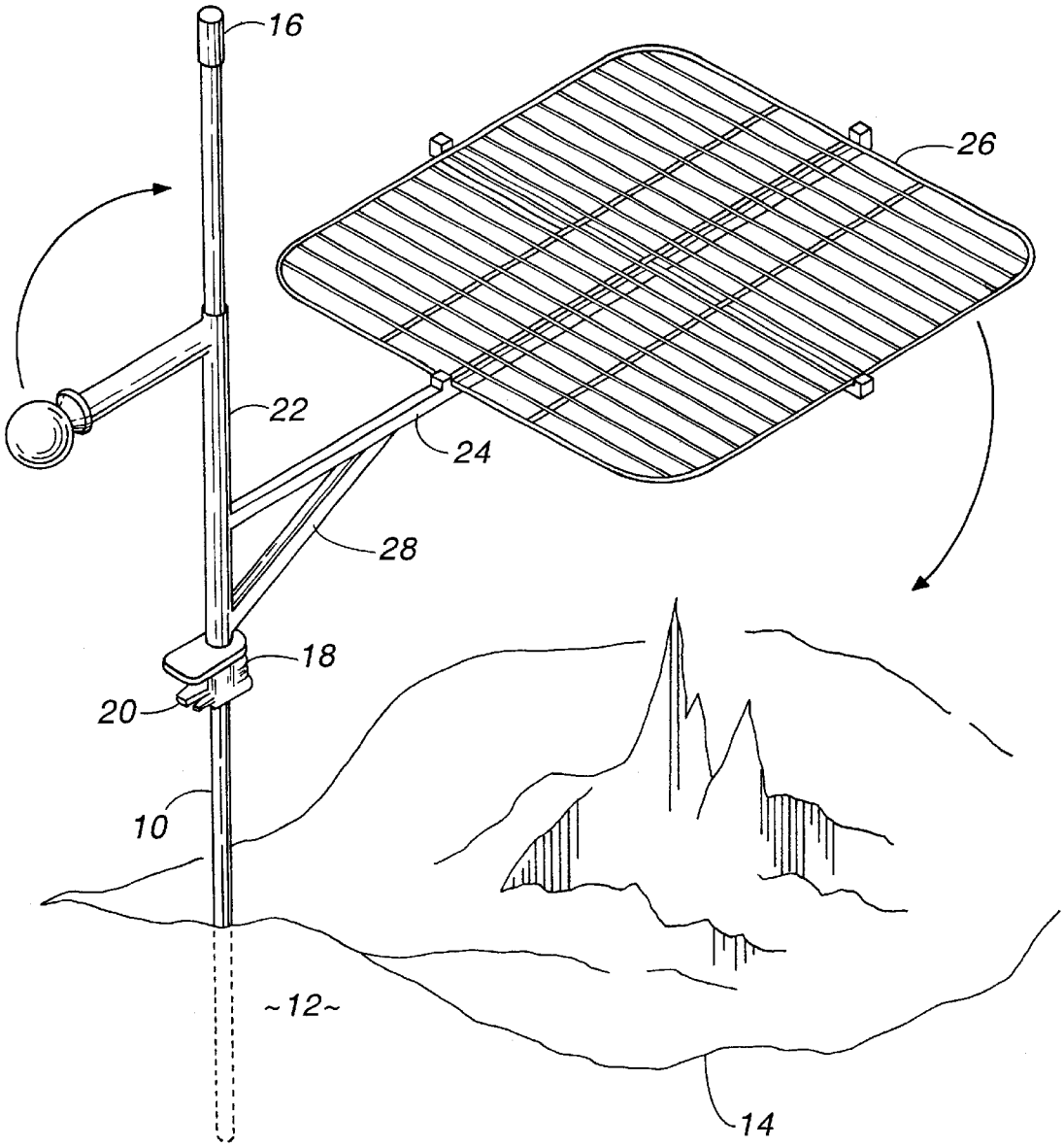
FIG. 1 is a perspective view of the fire pit grill over a fire pit.

In FIG. 1 a vertical support 10 is driven or otherwise inserted in the ground 12 adjacent a fire pit 14. To prevent damage to the vertical support 10 a removable stainless steel cap 16 fits over the upper end of the vertical support to thereby absorb hammer blows in driving the support into the ground. Vertically movable on the vertical support 10 is a stop 18 having a release 20 that permits the stop to be positioned at any vertical location desired on the support as illustrated in FIGS. 3*a* and 3*b* where the extreme vertical positions are illustrated.

Figures 2, 3A, 3B:
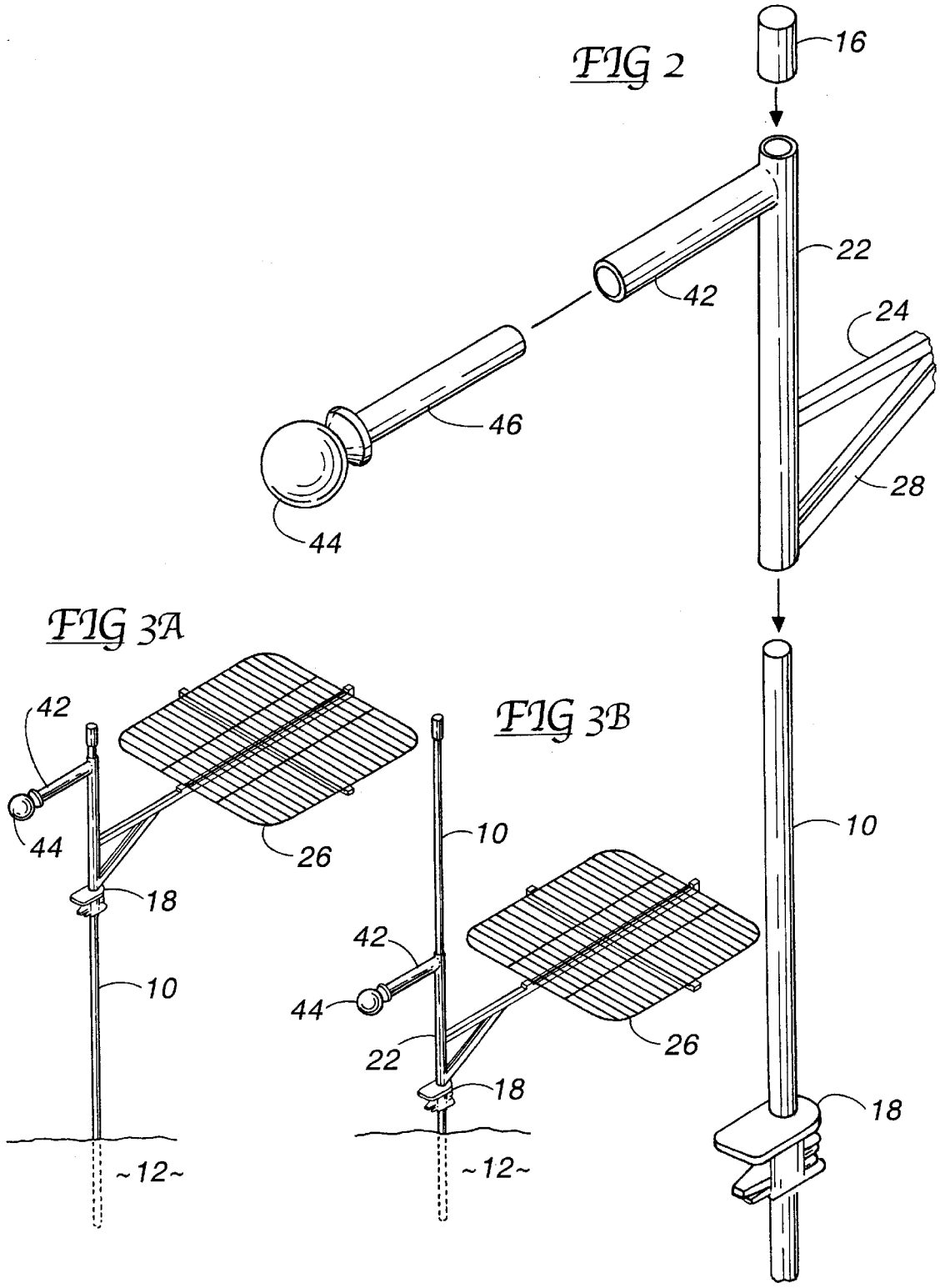
FIG. 2 is an exploded cutaway view of the fire pit grill.
FIG. 3A and FIG. 3B illustrates the height adjustable aspect of the fire pit grill.

A sleeve 22 fits over the vertical support 10, as also shown in FIG. 2, and is free to rotate thereon. The sleeve rests upon the adjustable stop 18. Welded to the sleeve 22 is a horizontal bracket 24 which extends to support a grill surface 26. A diagonal brace 28 is welded between the sleeve 22 and the bracket 24 to reinforce the bracket 24.

Figure 4:
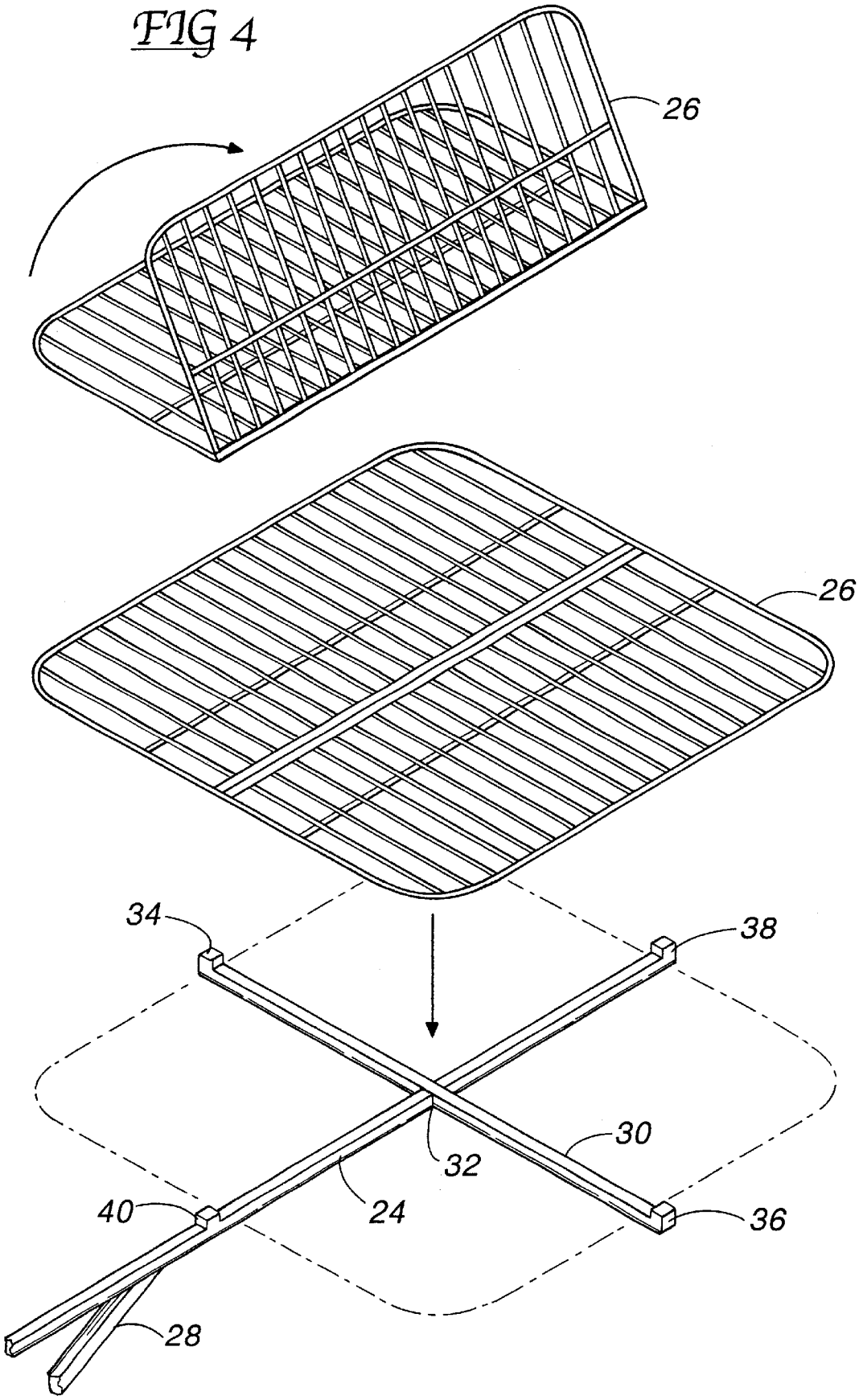
FIG. 4 is a sequential view of the assembly of the grill surface to the grill bracket.

As best shown in FIG. 4 a cross-bracket 30 is notched and fitted in a notch at 32 in the bracket 24. The cross-bracket 30 provides lateral support to the grill surface 26 enabling a folding grill surface to be used. At the ends 34 and 36 of the cross-brace 30 are a pair of vertical limits. Similar vertical limits are at the end 38 of the bracket 24 and intermediate 40 on the bracket. These limits 34, 36, 38, and 40 serve to retain the grill surface 26 on the bracket 24 and cross-brace 30. The complementary notches at 32 are carefully formed to prevent the cross-brace 30 from tilting out from the bracket 24 when the grill surface 26 is in place. However, assembly and disassembly is a matter of seconds without any tools.

Returning to FIGS. 1 and 2 opposite the bracket 24 is a horizontal tube 42 also welded to the sleeve 22. A wooden or plastic handle 44 includes a cylindrical portion 46 which fits inside the tube 42 to complete the assembly of the fire pit grill. Thus, the entire fire pit grill can be assembled and disassembled in a matter of seconds without any tools. Only a hammer or large rock is needed to hammer the vertical support 10 into the ground.

Obvious modifications to the fire pit grill are apparent. For example, the grill surface 26 may be circular, oval or some other shape. The grill surface 26 may be open as shown or solid for making pancakes and similar items. A soup pot may be hung from the bracket 24. The vertical support 10 may be formed with discrete vertical locations and the stop 18 configured to ratchet into any one of the discrete locations. Likewise, the handle 44 may be configured into other shapes. Where the vertical support cannot be hammered into the ground, it may be mounted in a large concrete block or steel plate.

Figure 5A:
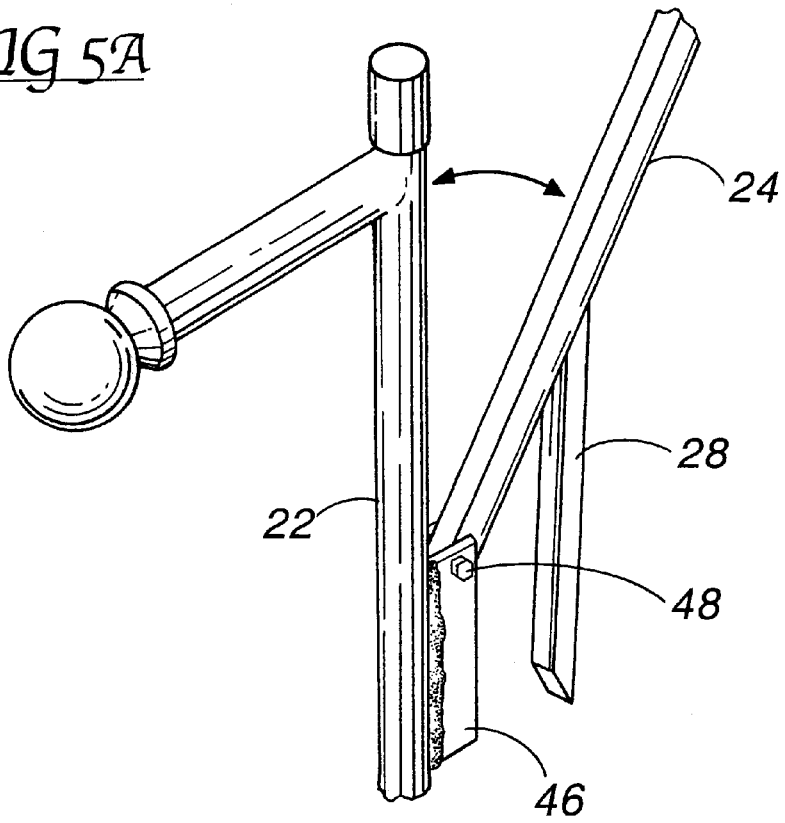
FIG. 5A and FIG. 5B illustrates an alternate folding bracket for the grill.
Figure 5B:
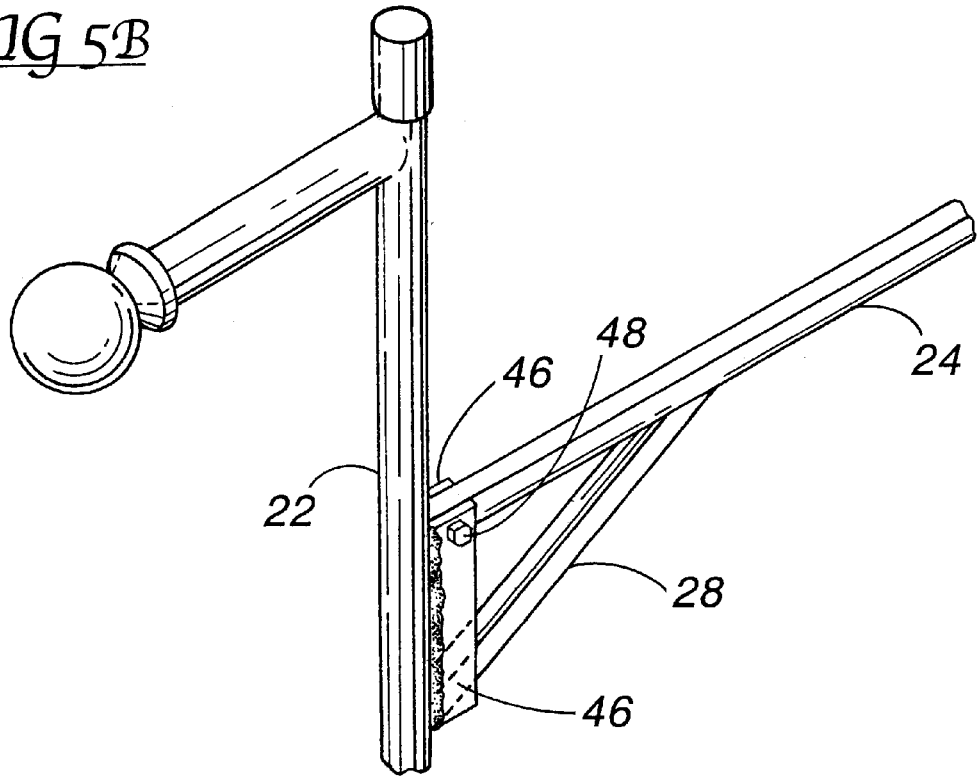

In FIG. 5 the sleeve 22 and bracket 24 are modified by welding a pair of plates 46 to the sleeve and fastening the bracket 24 to the plates with a pin 48 through holes in the plates. The diagonal brace 28 is only permanently fastened to the bracket 24 and free to slide between the lower ends of the plates 46 when the bracket is lowered to the horizontal position. Thus, the bracket 24 can be folded parallel with the sleeve 22.

Figure 6:
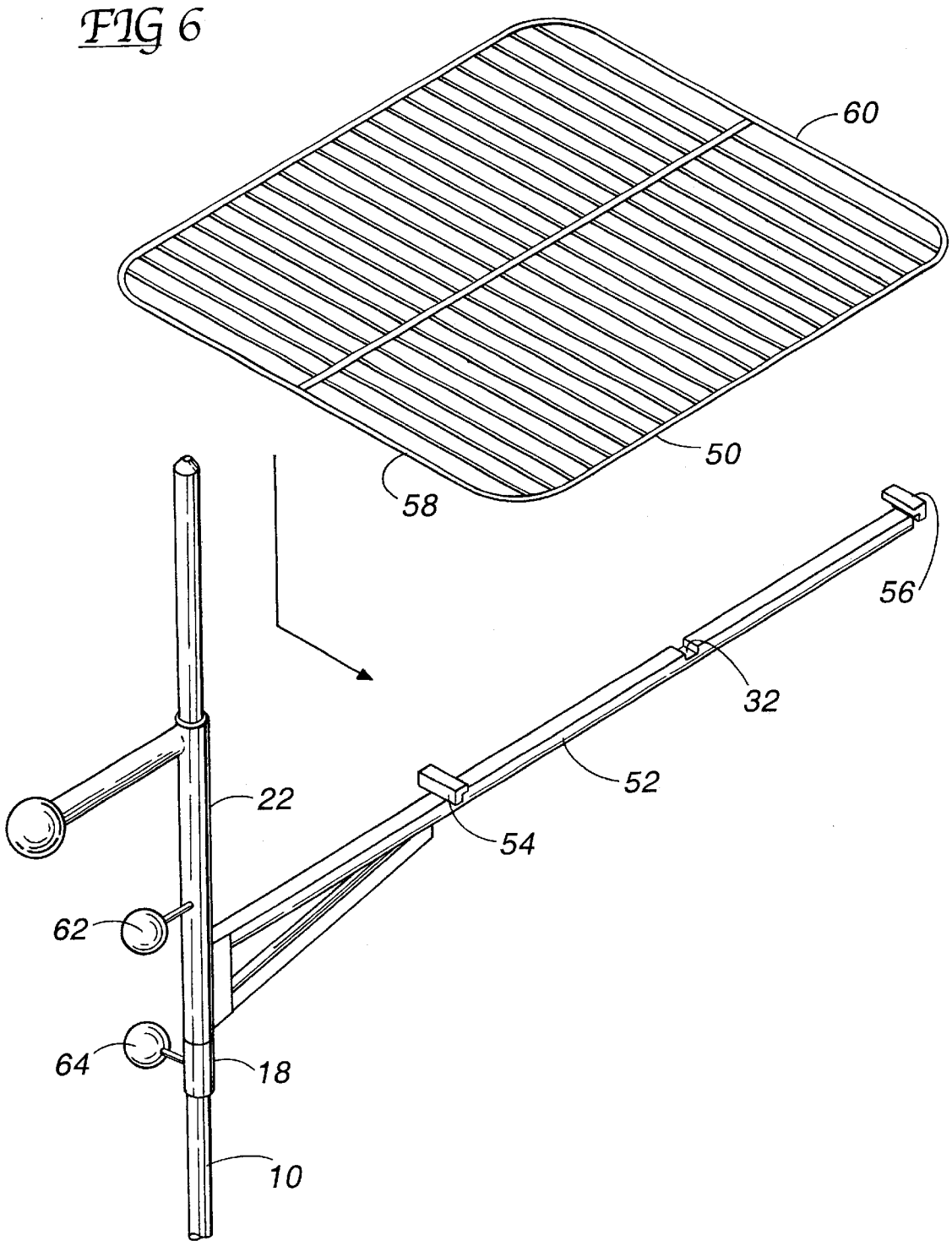
FIG. 6 illustrates an alternative form of bracket for supporting the grill surface.
Figure 7:
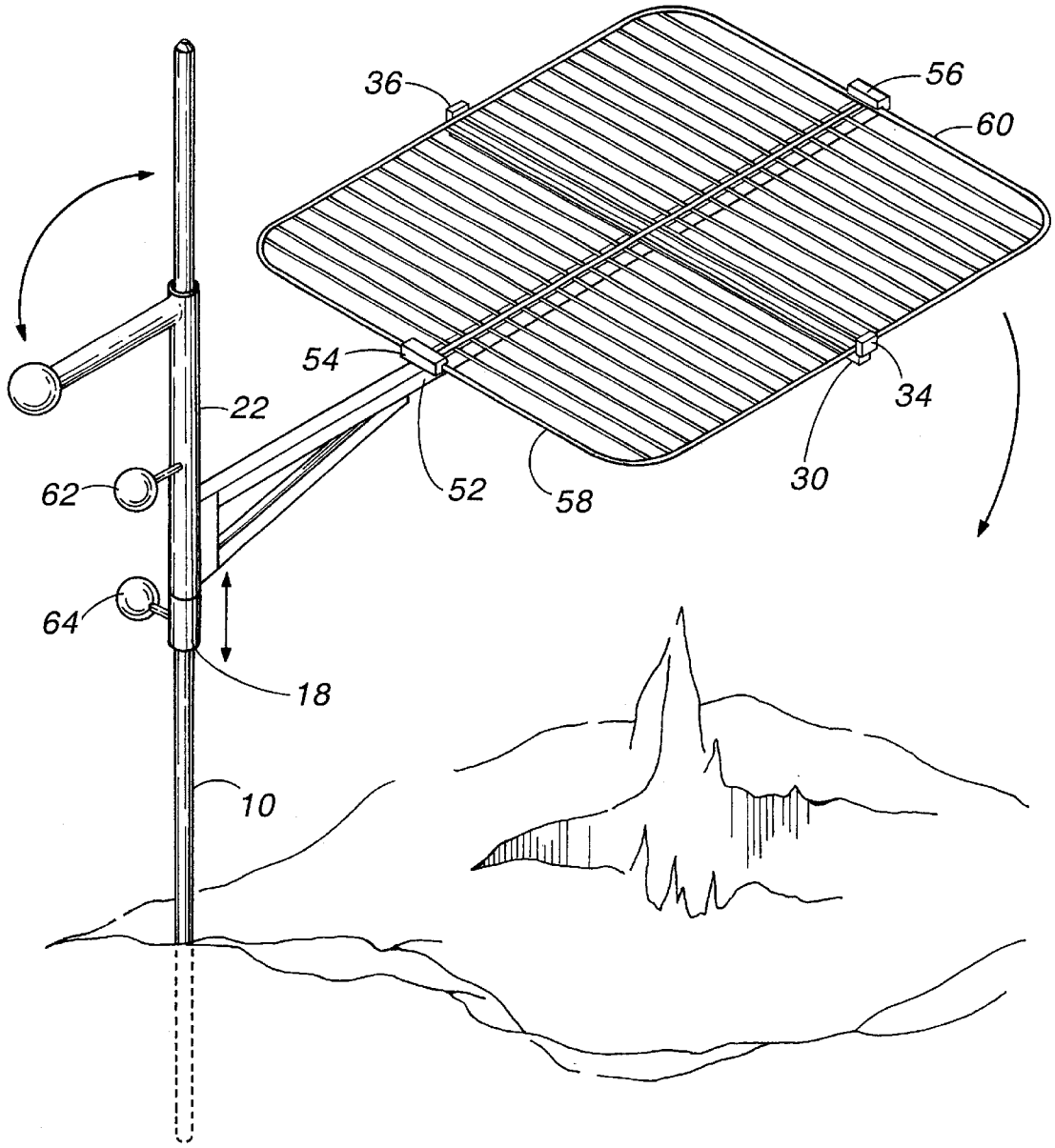
FIG. 7 illustrates in perspective alternate forms of adjustment for the grill.

FIG. 6 shows a non-folding grill 50 that fits on a modified bracket 52. The bracket modification includes a pair of L-shaped pieces 54 and 56 welded facing each other to form slots through which the outside elements 58 and 60 of the grill 50 can slide as best shown in FIG. 7. The L-shaped pieces 54 and 56 are sufficiently long to prevent tilting of the grill 50 or as shown in FIG. 7 the cross-bracket 30 with stops 34 and 36 can be used.

In addition FIGS. 6 and 7 show screw tighteners 62 and 64 for the sleeve 22 and adjustable stop 18.

Figure 8:
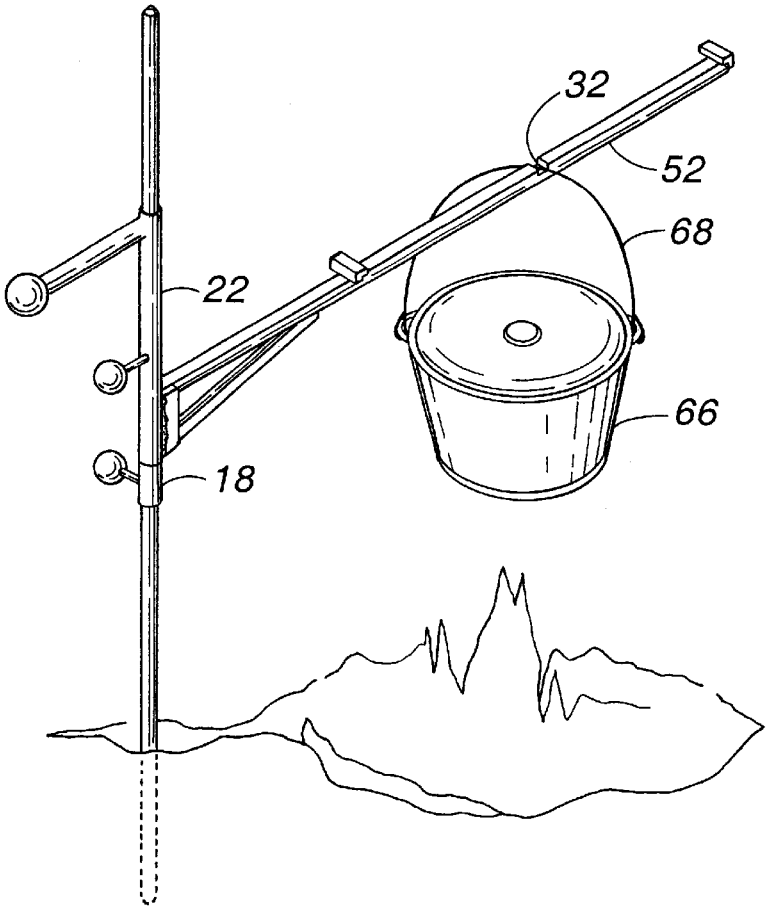
FIG. 8 illustrates in perspective the bracket as a pot holder.
Figure 9:
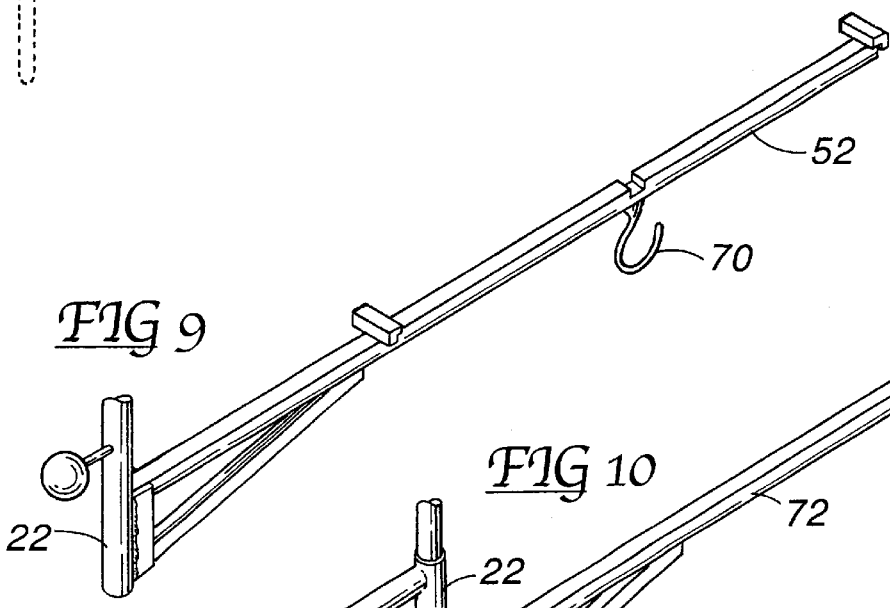
FIG. 9 illustrates a bracket modified to support a hanging item.
Figure 10:
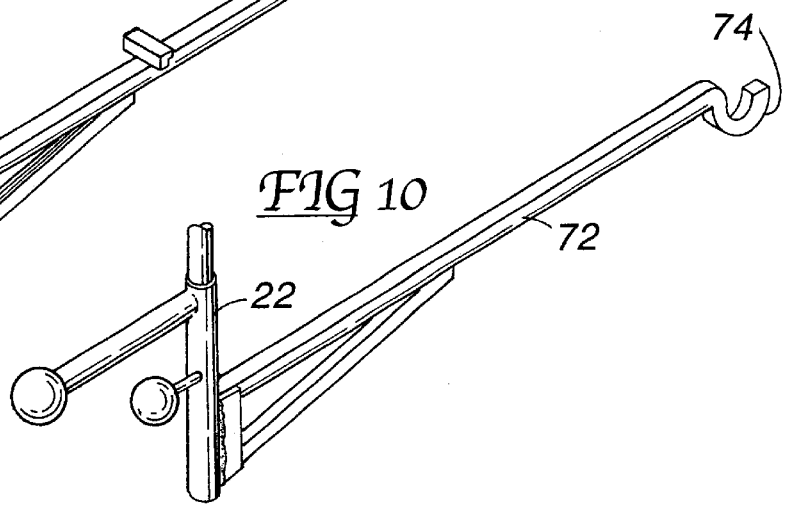
FIG. 10 illustrates a bracket modified in an alternative manner to support a hanging item.

FIGS. 8, 9, and 10 illustrate various ways a pot 66 with a pot handle 68 might be hung from a bracket 52. In FIG. 8 the pot handle 68 fits in the slot 32. In FIG. 9 a hook 70 is welded beneath the bracket 52 and in FIG. 10 a special bracket 72 is formed with a hook 74 shape at the end.

Figure 11:
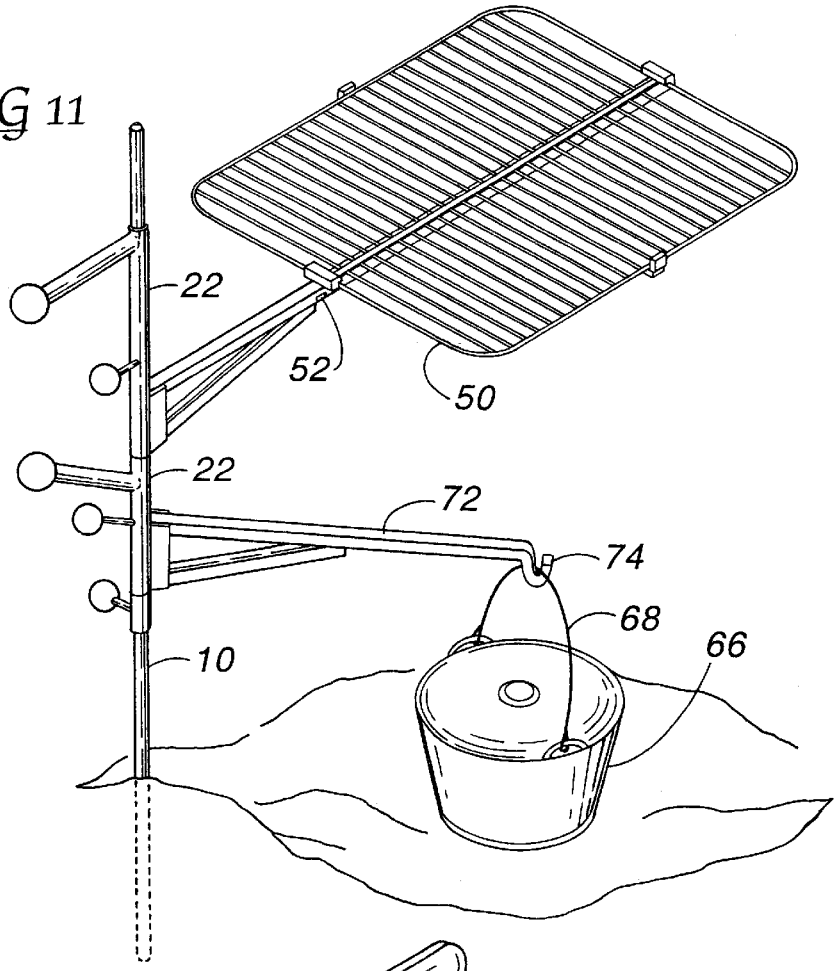
FIG. 11 illustrates in perspective a pair of brackets for supporting a grill surface and hanging pot simultaneously.
Figure 12:
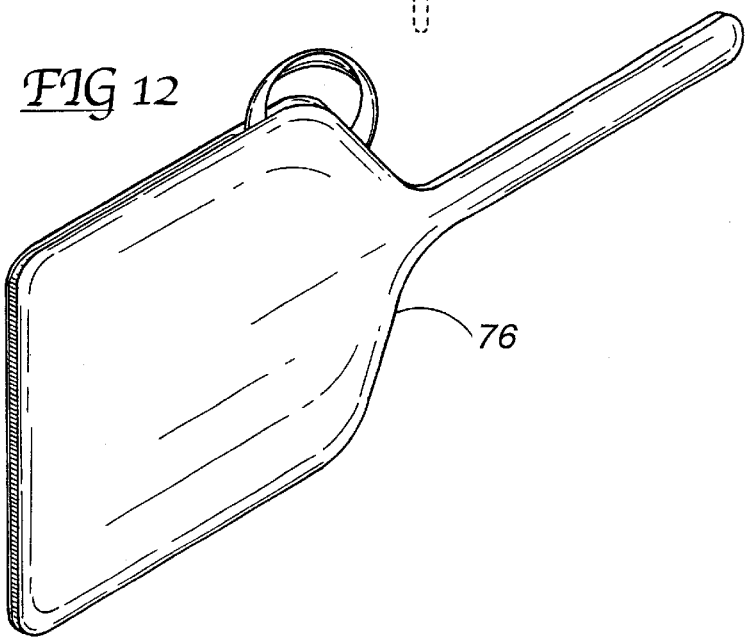
FIG. 12 illustrates a carrying case for the fire pit grill.

FIG. 11 illustrates the simultaneous use of the grill 50 and the special bracket 72 with the pot 66 on the same vertical support 10 and FIG. 12 illustrates a carrying case 76 suitable for the grill wherein the bracket 52 folds against the sleeve 22 as in FIG. 5.

What is claimed is:

1. A fire pit grill comprising a vertical support, a sleeve rotatable and vertically movable on the support, a horizontal bracket mounted on the sleeve, said horizontal bracket rotatable between perpendicular and parallel positions relative to the sleeve, a cross-bracket supported on the bracket, a grill surface removably supported on the bracket, a handle extending from the sleeve in a direction substantially opposite from the bracket and means vertically adjustable on the vertical support to support the sleeve.

2. The fire pit grill of claim 1 wherein said cross-bracket is perpendicular to the bracket beneath the grill surface.

3. The fire pit grill of claim 1, including a pair of facing slot forming pieces to retain the grill surface on the bracket, said slot forming pieces mounted on the bracket to retain opposite outside elements of the grill surface.

4. The fire pit grill of claim 1 wherein the grill surface folds.

5. The fire pit grill of claim 2, including vertical limits on the bracket and cross-bracket.

6. A fire pit grill comprising a vertical support, a sleeve rotatable and vertically movable on the support, a horizontal bracket mounted on the sleeve, said horizontal bracket rotatable between perpendicular and parallel positions relative to the sleeve, a cross-bracket supported on and perpendicular to the bracket, a grill surface removably supported on the bracket and cross-bracket, a handle extending from the sleeve in a direction substantially opposite from the bracket and means vertically adjustable on the vertical support to support the sleeve.

7. The fire pit grill of claim 6 wherein the grill surface folds.

8. The fire pit grill of claim 6, including vertical limits on the bracket and cross-bracket.

9. A fire pit grill comprising a vertical support, a sleeve rotatable and vertically movable on the support, a horizontal bracket mounted on the sleeve, said horizontal bracket rotatable between perpendicular and parallel positions relative to the sleeve, a grill surface removably supported on the bracket, a pair of facing slot forming pieces engageable with outside elements of the grill surface, said facing slot forming pieces mounted on the bracket, a handle extending from the sleeve in a direction substantially opposite from the bracket and means vertically adjustable on the vertical support to support the sleeve.

10. The fire pit grill of claim 9 wherein the grill surface folds.

* * * * *